United States Patent [19]

Roehl

[11] 4,289,542

[45] Sep. 15, 1981

[54] METHOD OF VAPOR DEGREASING

[75] Inventor: Ernest O. Roehl, Huntington Beach, Calif.

[73] Assignee: Rho-Chem Corporation, Ingelwood, Calif.

[21] Appl. No.: 163,988

[22] Filed: Jun. 30, 1980

[51] Int. Cl.[3] ..... B083 7/00

[52] U.S. Cl. ..... 134/11; 134/31; 134/40; 570/122

[58] Field of Search ..... 134/11, 31, 40; 252/162, 364, 399, DIG. 9; 570/122

[56] References Cited

U.S. PATENT DOCUMENTS

| | | | |
|---|---|---|---|
| 2,070,962 | 2/1937 | Reid | 252/DIG. 9 |
| 2,896,640 | 7/1959 | Randall et al. | 134/11 X |
| 3,028,267 | 4/1962 | Edhofer et al. | 134/11 X |
| 3,123,083 | 3/1964 | Kearney et al. | 134/11 X |
| 3,274,700 | 9/1966 | Maguire et al. | 134/11 X |
| 3,839,087 | 10/1974 | Beckers | 134/31 |
| 4,046,820 | 9/1977 | Goodner et al. | 570/122 X |

FOREIGN PATENT DOCUMENTS

| | | | |
|---|---|---|---|
| 1143851 | 2/1969 | United Kingdom . | |
| 573915 | 10/1977 | U.S.S.R. | 252/162 |

*Primary Examiner*—Marc L. Caroff

*Attorney, Agent, or Firm*—Donald M. Cislo

[57] ABSTRACT

A contaminated article is subjected to vapor degreasing operations wherein the vapor degreasing solvent comprises a blend consisting essentially of perchlorethylene and trichlorethylene, wherein in the preferred embodiment, the perchlorethylene comprises about 81 volume percent of the degreasing solvent, while the trichlorethylene comprises the remaining 19 volume percent of the solvent blend.

The solvent blend extends the normal life of perchlorethylene degreasing solvents alone, or in combination with stabilizers and the like, or, alternatively, allows the utilization of trichlorethylene at temperatures higher than those that would normally cause pyrolysis. The degreasing solvent blend not only extends the operational life of perchlorethylene-based vapor degreasing solvents, but also reduces the cost of conducting vapor degreasing operations.

6 Claims, No Drawings

METHOD OF VAPOR DEGREASING

BACKGROUND OF THE INVENTION

With the advent of OPEC, and the high cost and short supply of hydrocarbons, alternatives for existing vapor degreasing solvents has intensified.

The ordinary vapor degreasing solvents are normally chlorinated hydrocarbon ones, which meet the criteria of having no flash point and possessing good contaminant solvency and reusability through reclamation processes.

The prior art has utilized, as the basic vapor degreasing solvent, perchlorethylene for use in the ubiquitous vapor degreasing machine and operation. The perchlorethylene ordinarily is used in conjunction with a stabilizer which will extend the useful life of the vapor degreasing solvent.

That is, in the vapor degreasing process, a nonflammable solvent is boiled to produce a vapor zone, the height of which is controlled by condensing coils. Cold work is introduced into the vapor, causes vapor condensation thereon, and the contaminant carried on the cold work, usually oil, grease or flux, is flushed off by the liquid solvent condensate. The contaminant, along with the condensate, is returned to the boiling sump of the vapor degreasing machine. This condensate, or distillate, then is revaporized to repeat the cycle of cleansing through condensation.

The work piece which is to be cleansed is held in the vapor zone until the temperature thereof reaches the vapor temperature within the vapor zone, at which time condensation stops. Vapor flushing is usually followed by pure distillate spray and/or liquid immersion. The cool, pure distillate reduces the temperature of the metal surface below the vapor temperature producing a second vapor condensation. When the work piece again reaches vapor temperature, it is withdrawn from the vapor zone, clean and dry.

The vapor degreasing solvent is used at its boiling point in order to produce the vapor zone necessary for vapor condensation and resultant cleaning.

Where perchlorethylene alone or in conjunction with certain stabilizers to prolong the life thereof are utilized, serious drawbacks occur.

That is, during the degreasing operations, the perchlorethylene is adversely affected by the increasing amounts of contaminants finding their way into the boiling sump in that the boiling temperature of the perchlorethylene in the sump increases as the amount of contaminant increases. To compensate for this added contamination, solvent manufacturers add acid inhibitors or stabilizers in an effort to extend its vapor degreasing life.

When the temperature in the boiling sump of the vapor degreasing device reaches and exceeds the range of approximately 256°–258° F., normally signifying 25–30% volume percent contamination, depletion of the stabilizers is nearly complete and additional usage of the perchlorethylene is not recommended because of acidic breakdown and failure.

Vapor degreasing handbooks recommend that perchlorethylene vapor degreasers be shut down and the degreasing operation terminated to allow clean-out of the boiling sump once the boiling sump temperatures reach about 256° F. The general criteria, measured in other terms for solvent rejuvenation, are when the boil sump specific gravity is 1.44 or has an acid acceptance value of about 0.02–0.06, or wherein the pH value is between about 5.5–6.0.

In order to extend the life of perchlorethylene by as much as 50%, and to reduce the boiling sump temperature, even with contamination present, and to provide a satisfactory vapor degreasing solvent of lower cost, it has been found that the addition of trichlorethylene to perchlorethylene in an amount to reduce the initial boiling temperature of the resultant blend to about 240° F. achieves definite attributes, while alleviating many of the detriments found in prior art uses and methods of vapor degreasing using perchlorethylene alone or with stabilizers to extend its useful life.

OBJECTS AND SUMMARY OF THE INVENTION

It is an object of the invention to provide a perchlorethylene-trichlorethylene vapor degreasing solvent of advantageous characteristics.

It is another even further object of the invention to provide a vapor degreasing solvent comprising a solvent blend of perchlorethylene and trichlorethylene wherein the initial boiling temperature thereof is about 240° F.

It is still another even further, more specific object of the invention to provide a vapor degreasing solvent of perchlorethylene and trichlorethylene wherein the perchlorethylene comprises about 81 volume percent of the solvent mixture.

It is another even further, more specific important object of the invention to provide a method of conducting vapor degreasing operations utilizing the vapor degreasing solvent of the invention.

It is another even further, more specific object of the invention to provide a vapor degreasing operation wherein a perchlorethylene-trichlorethylene solvent blend is utilized where the vapor degreasing operation is conducted in reflux and recycling conditions and wherein the life of the vapor degreasing solvent blend is substantially extended.

It is another even further, even more specific object of the invention to provide a vapor degreasing method and operation wherein the solvent blend used in said method or operation has a lower initial boiling point, and thus is capable of satisfactorily operating in a vapor degreasing environment over longer periods of time.

It is another even more and further specific object of the invention to provide a vapor degreasing method involving the creation of a solvent boiling zone wherein solvent introduced therein is a blend of perchlorethylene and trichlorethylene and wherein contaminants and condensed vapor are returned to the boiling zone and wherein vapor degreasing operations are continuously carried out until such point as the temperature in the boiling zone reaches about 256° F.

It is still an even more important and further specific object of the invention to provide a vapor degreasing method of operation utilizing a vapor degreasing solvent comprising 81 volume percent of perchlorethylene and 19 volume percent trichlorethylene wherein the initial temperature of the resultant solvent blend is approximately 240° F. and continuing the degreasing operation by the addition of amounts of additional solvent blend of perchlorethylene and trichlorethylene and continuing the vapor degreasing operation until the temperature of the contaminated solvent blend in the boiling sump of the vapor degreasing apparatus approximates 256° F., thereafter discontinuing the vapor degreasing operation and reclaiming perchlorethylene—trichlorethylene solvent for reuse in vapor degreasing operations.

In an exemplary embodiment, the invention is directed to the method of vapor degreasing, using a solvent consisting essentially of perchlorethylene wherein the improvement comprises adding a sufficient amount of trichlorethylene to reduce the initial boiling point of the resultant solvent blend to about 240° F. and thereafter conducting vapor degreasing operations with the solvent blend at reflux temperatures and removing contaminants with said solvent, until the temperature of the contaminated solvent blend reaches about 256° F.

These and other further objects of the invention will become apparent from the hereinafter following commentary.

DESCRIPTION OF THE BEST EMBODIMENTS CONTEMPLATED

In the conventional vapor degreasing apparatus, a boiling chamber or sump contains a heating element thereby forming a boiling zone. Positioned above the boiling zone is a vapor condensation zone wherein condensing coils and cooling jacket may be employed to condense vapors therein. In operation on a straight vapor cycle, the work piece to be cleaned is lowered into the vapor zone and is washed by solvent vapors which condense on the work piece surface. The resulting condensate flows from the surface of the work piece together with the contaminants and drips back into the boiling solvent contained in the boiling chamber or boiling sump.

When the work piece temperature reaches that of the vapors in the vapor zone, condensation and cleaning action ceases. In some instances, vapor losses of the solvent contained in the boiling chamber or boiling sump is maintained at the operational level by addition of solvent, and by the continuous return of the condensate from the work piece being cleaned, which, of course, will also take with it into the boiling sump or boiling chamber, contaminants comprising oil, grease and the like.

In this type of vapor degreasing apparatus, which is of the conventional type, vapor degreasing may continue until such time as adversely high temperatures result in the boiling sump or boiling zone. This is for the reason that, while the initial boiling point of the boiling sump or boiling zone may be that of the degreasing solvent being used, i.e. 250° F., the vapor degreasing action may only continue until such time as the contaminants in the boiling sump or boiling zone raise the temperature therein to 256°–258° F., at which time breakdown and failure of the, for example, perchlorethylene solvent may result. When this occurs, the vapor degreasing operation must be shut down, and the boiling sump cleaned out, and the vapor degreasing solvent replaced or subjected to a reclamation process, in order to remove the contaminants therefrom.

Where trichlorethylene alone or with stabilizers is utilized, its boiling point is approximately 188° F., and its use in a vapor degreasing operation wherein the boiling sump approached 250° F. would be contraindicated because of its well-known tendency for thermal decomposition or pyrolysis at this temperature.

However, contrary to what the prior art would indicate, and in accordance with this invention, a solvent blend comprising perchlorethylene and trichlorethylene in an amount sufficient to reduce the initial boiling point of the resultant solvent blend to about 240° F., has been found to satisfactorily extend the useful life of a vapor degreasing solvent in a vapor degreasing operation, subject to the contamination referred to hereinabove. Attendant energy saving results because of these lower temperature requirements.

Thus, it has been found by the addition of trichlorethylene in about the range of about 0.1 volume percent to 50.0 volume percent to perchlorethylene, a blended solvent is obtained which has a lower initial boiling point than perchlorethylene alone, and wherein the resultant solvent blend is capable of operating at temperatures substantially higher than those that would normally be predicted for trichlorethylene alone without pyrolysis. The preferred range for the solvent blend in order to increase useful life thereof is 81 volume percent for perchlorethylene and 19 volume percent for the trichlorethylene.

The solvent blend comprising the perchlorethylene and trichlorethylene provides a constant boiling point solvent exhibiting stable operating characteristics in a vapor degreaser. The theory which would appear to explain the lack of fractionation of the two disparate solvents, making up the solvent blend of the invention, would appear to be as a result of Raoult's Law.

In accordance with Raoult's Law, groups of similar solvents are classified in specific classes and in accordance with theory, a solvent blend of two or more components of the same class of solvents will operate in a state of total reflux (applied to vapor degreasing where the blend is boiled, vapors condensed, and condensate returned to boiling sump) and equilibrium will result wherein the temperatures and compositions of both the vapor phase and the boiling liquid phase are constant.

In order to comply with the criteria of the application of Raoult's Law, in the operation of the instant invention, minor losses of vapor and condensate in the vapor degreasing operation are replaced through daily solvent make-up with solvent comprising the solvent blend of perchlorethylene and trichlorethylene as alluded to hereinbefore.

In order to ascertain the functionability of the application of the theory behind the solvent blend as being applicable to the practice of the invention, a commercially available grade of perchlorethylene was refluxed with different volumes of oil until acid breakdown of the solvent occurred. The length of time which it took for the perchlorethylene to reach the breakdown point was recorded in each instance. Thereafter, a solvent blend of perchlorethylene and trichlorethylene, in accordance with the volume percentages set forth hereinabove, was similarly tested under the same conditions.

It was found that the perchlorethylene—trichlorethylene solvent blend had an extended life and the initial boiling point of the solvent blend was lower than that of perchlorethylene alone. In conducting the tests, a neutral mineral oil is used in varying amounts to provide different boiling temperatures in the boiling zone or boiling sump to determine acid deterioration of the solvent. Each of the solvents and solvent/oil blends was boiled at total reflux for a number of days. That is, two 500 milliliter flasks were connected to condensing columns measuring 400 millimeters in jacket length. These were, in turn, connected to water sources by $\frac{3}{8}$ inch tubing to continuously cool the columns. For maintained heating, the flasks and solvent solutions were placed on a 12 inch square hotplate.

During the test periods and at selected intervals, each of the samples was tested for acidic deterioration by determining its acid acceptance value in accordance with A. S. T. M. procedure D-2942. In this test method, a known amount of standard hydrochlorination reagent is used and % acid acceptance value is calculated following titration with 0.1 N NaOH. The acid acceptance value of virgin vapor degreasing grade perchlorethylene is in the range of 0.10 to 0.20%. The acid acceptance determinations use 10 and 25 millimeter volumetric pipettes to transfer the solutions into 400 millimeter beakers. The pH of the solution during the tests were checked further using a digital pH meter in conjunction with a stirring rod and magnetic stirrer in order to obtain an homogeneous mixture.

Solvent manufacturers usually recommend that perchlorethylene be cleaned out from the vapor degreaser when the acid acceptance value drops to the range of about 0.02 to 0.06% which correlates with oil contamination of about 25% to 30%. In the tests, the solvents were refluxed beyond the recommended clean-out values to total acidic decomposition to determine maximum life of the solvent.

These tests are tabulated in the following Table I.

TABLE I

| Sample | Oil, % Volume | Boil Temp. | Hours of Refluxing Before Acidic Failure |
|---|---|---|---|
| Run 1 | | | |
| Perchlorethylene | 0 | 250° F. | 2088* |
| Blend, perc./tri. | 0 | 240° F. | 2088* |
| Run 2 | | | |
| Perchlorethylene | 25% | 258° F. | 1560 |
| Blend, perc./tri. | 25% | 247° F. | 1920 |
| Run 3 | | | |
| Perchlorethylene | 40% | 260° F. | 432 |
| Blend, perc./tri. | 40% | 252° F. | 696 |
| Run 4 | | | |
| Perchlorethylene | 50% | 264° F. | 192 |
| Blend, perc./tri. | 50% | 254° F. | 624 |

*Test discontinued at this time. Acid acceptance values of the two samples showed no significant difference and were both in the 0.01 to 0.02% range.

From the foregoing, it will be noted that the addition of trichlorethylene to perchlorethylene without oil contaminant does nothing more than lower the initial boiling temperature as compared to perchlorethylene alone. However, upon the addition of oil and the like contaminants as would be found in the conventional vapor degreasing environment, the addition of trichlorethylene not only has an effect on the initial boiling point or temperature of the solvent, but also upon its useful life.

That is, the addition of trichlorethylene, as, for example, in test 2 extended the useful life of the solvent by as much as 23.1% before acidic breakdown, as compared with perchlorethylene alone. As contamination grew from 40 to 50%, as represented by runs 3 and 4 respectively, solvent life was extended 61.1% and 225.0% as compared to perchlorethylene alone.

In order to further prove the applicability of the solvent blend in vapor degreasing operations, another series of runs was conducted, utilizing commercially available perchlorethylene solvents, wherein each of the solvents was boiled at total reflux in the present of the types of contaminants usually found in typical industrial vapor degreasing applications including measured amounts of aluminum and iron metal fines with heavy duty machine oil. At spaced intervals, each of the solvents was tested for acidic deterioration similar to that testing procedure as set forth for the runs tabulated in Table I.

The results of the test runs are tabulated in Table II hereinafter following, wherein the first six runs employed commercially available perchlorethylene, whereas the seventh run employed the perchlorethylene-trichlorethylene blend comprising 81 volume percent perchlorethylene and 19 volume percent trichlorethylene.

Each of the runs 1–6, inclusive, utilized a commercially available perchlorethylene, industrial solvent specifically designated for vapor degreasing. Thus, each of samples (1–6) compared to the solvent blend (7) of the invention as follows:

TABLE II

| | | HOURS OF OPERATION | | | | | | | | | | | |
|---|---|---|---|---|---|---|---|---|---|---|---|---|---|
| | | 24 | 48 | 72 | 96 | 120 | 144 | 168 | 192 | 216 | 240 | 264 | 288 |
| | | OIL CONTAMINANT, BY VOLUME | | | | | | | | | | | |
| Run | SOLVENT | 25% | 40% | 50% | 50% | 50% | 50% | 50% | | | | | |
| 1 | Perchlorethylene 1 | xxxxoooo .035 | 0.0 | | | | | | | | | | |
| 2 | Perchlorethylene 2 | ——— | xxxxxoooo 0.05 | 0.0 | | | | | | | | | |
| 3 | Perchlorethylene 3 | ——— | ——— | xxxxxoooo | | | | | | | | | |
| 4 | Perchlorethylene 4 | 0.12 | 0.06 | 0.0 | | | | | | | | | |
| | | ——— | ——— | xxxxoooo | | | | | | | | | |
| | | 0.11 | 0.06 | 0.0 | | | | | | | | | |
| 5 | Perchlorethylene 5 | ——— | ——— | ——— | xxxxoooo | | | | | | | | |
| | | 0.14 | 0.11 | 0.04 | 0.0 | | | | | | | | |
| 6 | Perchlorethylene 6 | ——— | ——— | ——— | ——— | xxxxoooo | | | | | | | |
| | | 0.17 | 0.14 | 0.12 | 0.06 | 0.0 | | | | | | | |
| 7 | Blend, perc./tri. | ——— | ——— | ——— | ——— | ——— | ——— | xxxxoooo | | | | | |
| | | 0.18 | 0.17 | 0.16 | 0.12 | 0.07 | 0.02 | 0.0 | | | | | |

KEY: ———: Safe Operation
xxxx : Clean-Out Recommended
oooo : Solvent Failure

The foregoing TABLE II illustrates that, as with increasing oil contamination by volume, the perchlorethylene solvent becomes less effective and it was found that Run 7, comprising the blended solvent, had an extended useful life over the perchlorethylene solvent alone as used in Runs 1–6 inclusive.

The acid acceptance values of the solvents of Runs 1–7 inclusive of Table II were determined with 25% by volume oil contaminants. The hours of operation before acidic failure occurred were also determined, and the results of these tests are tabulated in TABLE III:

TABLE III

| SOLVENT TESTED | HOURS OF OPERATION 24 | 48 | 72 | 96 | 120 | 144 | 158 | 192 | 216 | 240 | 264 | 288 |
|---|---|---|---|---|---|---|---|---|---|---|---|---|
| 1 Perchlorethylene 1 | xxxxoooo | | | | | | | | | | | |
| | 0.03 | 0.7 | | | | | | | | | | |
| 2 Perchlorethylene 2 | ——— | ——— | ——— | ——— | xxxxoooo | | | | | | | |
| | | | 0.04 | 0.02 | 0.0 | | | | | | | |
| 3 Perchlorethylene 3 | ——— | ——— | ——— | ——— | ——— | xxxxoooo | | | | | | |
| | | | 0.05 | 0.05 | 0.03 | 0.0 | | | | | | |
| 4 Perchlorethylene 4 | ——— | ——— | ——— | ——— | ——— | xxxxoooo | | | | | | |
| | | | 0.09 | 0.07 | 0.02 | 0.0 | | | | | | |
| 5 Perchlorethylene 5 | ——— | ——— | ——— | ——— | ——— | xxxxoooo | | | | | | |
| | | | 0.07 | 0.05 | 0.03 | 0.0 | | | | | | |
| 6 Perchlorethylene 6 | ——— | ——— | ——— | ——— | ——— | ——— | ——— | xxxxoooo | | | | |
| | | | 0.13 | 0.12 | 0.12 | 0.07 | 0.05 | 0.02 | 0.0 | | | |
| 7 Blend,perc./tri. | ——— | ——— | ——— | ——— | ——— | ——— | ——— | ——— | ——— | ——— | ——— | xxxxoooo |
| | | | 0.14 | 0.14 | 0.12 | 0.10 | 0.10 | 0.08 | 0.07 | 0.05 | 0.01 | 0.0 |

KEY:
———: Safe Operation
xxxx : Clean-Out Recommended
oooo : Solvent Failure

Thus, there has been disclosed a unique method of carrying out vapor degreasing operations utilizing a solvent blend that has an extended useful life and lower initial boiling point than perchlorethylene alone. The resultant solvent blend by reason of its lower boiling point, utilizes less energy and is more economical than perchlorethylene degreasing solvent alone in that lower heat requirements makes for increased fuel efficiency.

While the solvent blend has been disclosed as comprising about 0.1 volume percent to 50.0 volume percent perchlorethylene and trichlorethylene, it is preferred to utilize a solvent blend comprising 81 volume percent perchlorethylene and 19 volume percent trichlorethylene. Because of unique operational characteristics of solvent blends, the preferred solvent for use in the vapor degreasing method of the invention comprises a solvent consisting essentially of perchlorethylene having a trichlorethylene component in an amount sufficient to produce a resultant solvent blend having a boiling point of about 240° F.

While I have described particular embodiments of my invention for purposes of illustration, it is understood that other modifications and variations will occur to those skilled in the art, and the invention accordingly is not to be taken as limited except by the scope of the appended claims. Those of ordinary skill will recognize that the solvent blend of the invention is more economical because gallon for gallon more work product can be vapor degreased than with the straight perchlorethylene solvent.

What is claimed is:

1. In a method of vapor degreasing by contacting a contaminated article with vapors of a solvent consisting essentially of perchlorethylene, the improvement which comprises:

(a) adding a sufficient amount of trichlorethylene to the solvent to reduce the initial boiling point of the resultant solvent blend to about 240° F.; and (b) conducting vapor degreasng operations with the solvent blend of step (a) at reflux temperatures and removing contaminants with said solvent until the temperature of the contaminated solvent blend reaches about 256° F.

2. The method of vapor degreasing comprising the steps of:

(a) creating a solvent boiling zone;

(b) forming a solvent blend of about 81 volume percent perchlorethylene and 19 volume percent trichlorethylene;

(c) introducing said solvent blend into said boiling zone;

(d) refluxing said solvent blend and removing contaminants therewith by contacting a contaminated article with vapors of the solvent blend in a degreasing zone;

(e) continuing said vapor degreasing and returning solvent and contaminants to said boiling zone until the temperature in said boiling zone is about 256° F.; and (f) discontinuing said degreasing.

3. The method in accordance with claim 1 wherein the trichlorethylene component of said solvent blend is within the range of about 0.1 volume percent—50.0 volume percent.

4. The method in accordance with claim 3 which includes maintaining a boiling sump zone and additionally includes the steps of collecting and returning condensed solvent blend vapors to the boiling sump zone.

5. The method in accordance with claim 4 which includes the step of compensating for lost solvent by periodically adding additional solvent to said solvent blend to maintain the relative proportions of perchlorethylene to trichlorethylene.

6. The method in accordance with claim 5 wherein said solvent blend comprises 81 volume percent perchlorethylene and 19 volume percent trichlorethylene.

* * * * *